US007380590B2

(12) United States Patent
Hughes et al.

(10) Patent No.: US 7,380,590 B2
(45) Date of Patent: Jun. 3, 2008

(54) ROTATING PRESSURE CONTROL HEAD

(75) Inventors: William James Hughes, Bixby, OK (US); Murl Ray Richardson, Ft. Worth, TX (US)

(73) Assignee: Sunstone Corporation, Oklahoma City, OK (US)

( * ) Notice: Subject to any disclaimer, the term of this patent is extended or adjusted under 35 U.S.C. 154(b) by 195 days.

(21) Appl. No.: 10/922,029

(22) Filed: Aug. 19, 2004

(65) Prior Publication Data

US 2006/0037744 A1 Feb. 23, 2006

(51) Int. Cl.
*E21B 33/06* (2006.01)

(52) U.S. Cl. ..... 166/84.3; 166/84.4; 277/326; 285/391

(58) Field of Classification Search ..... 166/84.3, 166/84.4; 277/325, 326, 583, 645, 646; 285/391, 285/123.1
See application file for complete search history.

(56) References Cited

U.S. PATENT DOCUMENTS

| | | | | |
|---|---|---|---|---|
| 1,831,956 | A * | 11/1931 | Harrington | 277/326 |
| 2,207,199 | A * | 7/1940 | Hild | 175/195 |
| 3,410,508 | A * | 11/1968 | Fisher | 244/102 R |
| 4,073,352 | A | 2/1978 | Underwood | |
| 4,095,656 | A | 6/1978 | French | |
| 4,185,856 | A * | 1/1980 | McCaskill | 285/18 |
| 4,448,255 | A | 5/1984 | Shaffer et al. | |
| 4,949,785 | A | 8/1990 | Beard et al. | |
| 5,062,479 | A | 11/1991 | Bailey et al. | |
| 5,178,215 | A | 1/1993 | Yenulis et al. | |
| 5,273,108 | A | 12/1993 | Piper | |
| 5,279,365 | A | 1/1994 | Yenulis et al. | |
| 5,507,465 | A | 4/1996 | Borle | |
| 5,778,982 | A * | 7/1998 | Hauck et al. | 166/387 |
| 5,848,643 | A | 12/1998 | Carbaugh et al. | |
| 6,016,880 | A | 1/2000 | Hall et al. | |
| 6,024,172 | A | 2/2000 | Lee | |
| 6,109,348 | A | 8/2000 | Caraway | |
| 6,129,152 | A | 10/2000 | Hosie et al. | |
| 6,227,547 | B1 | 5/2001 | Dietle et al. | |
| 6,244,336 | B1 | 6/2001 | Kachich | |
| 6,470,975 | B1 | 10/2002 | Bourgoyne et al. | |
| 6,520,253 | B2 | 2/2003 | Calder | |
| 6,554,016 | B2 | 4/2003 | Kinder | |
| 6,626,245 | B1 | 9/2003 | Dallas | |
| 6,764,110 | B2 * | 7/2004 | Russell | 285/381.1 |
| 2002/0104660 | A1 | 8/2002 | Nice et al. | |

* cited by examiner

*Primary Examiner*—Kenneth Thompson
(74) *Attorney, Agent, or Firm*—Rudolf O. Siegesmund; Gordon & Rees LLP

(57) ABSTRACT

A Rotating Pressure Control Head (RPCH) with a rapid engagement mechanism is disclosed. The RPCH comprises an upper body and a lower body. The rapid engagement mechanism allows the upper body to be quickly disengaged from the lower body and replaced with a new upper body. The upper body comprises a sealing element and an inner housing that rotates with respect to an outer housing. The sealing element contains a plurality of internal cavities. The plurality of cavities control the constriction of the sealing element around the drill pipe.

38 Claims, 15 Drawing Sheets

ROTATING PRESSURE CONTROL HEAD

BACKGROUND OF THE INVENTION

The present invention is directed generally at controlling well head blow outs, and specifically to a rotating pressure control head having a rapid engagement mechanism and a replaceable and predictably deformable sealing element.

When the hydrostatic weight of the column of mud in a well bore is less than the formation pressure, the potential for a blowout exists. A blowout occurs when the formation expels hydrocarbons into the well bore. The expulsion of hydrocarbons into the well bore dramatically increases the pressure within a section of the well bore. The increase in pressure sends a pressure wave up the well bore to the surface. The pressure wave can damage the equipment that maintains the pressure within the well bore. In addition to the pressure wave, the hydrocarbons travel up the well bore because the hydrocarbons are less dense than the mud. If the hydrocarbons reach the surface and exit the well bore through the damaged surface equipment, there is a high probability that the hydrocarbons will be ignited by the drilling or production equipment operating at the surface. The ignition of the hydrocarbons produces an explosion and/or fire that is dangerous for the drilling operators. In order to minimize the risk of blowouts, drilling rigs are required to employ a plurality of different blowout preventers (BOPs), such as a rotating BOP, an annular BOP, a pipe ram, and a blind ram. Persons of ordinary skill in the art are aware of other types of BOPs. The various BOPs are positioned on top of one another, along with any other necessary surface connections such as nitrogen injection. The stack of BOPs and surface connections is called the BOP stack. A typical BOP stack is illustrated in FIG. 1.

One of the devices in the BOP stack is a rotating BOP. The rotating BOP is located at the top of the BOP stack and is part of the pressure boundary between the well bore pressure and atmospheric pressure. The rotating BOP creates the pressure boundary by employing a ring-shaped rubber or urethane sealing element that squeezes against the drill pipe, tubing, casing, or other cylindrical members (hereinafter, drill pipe). The sealing element allows the drill pipe to be inserted into and removed from the well bore while maintaining the pressure differential between the well bore pressure and atmospheric pressure. The sealing element may be shaped such that the sealing element uses the well bore pressure to squeeze the drill pipe or other cylindrical member. However, most rotating BOPs utilize some type of mechanism, typically hydraulic fluid, to apply additional pressure to the outside of the sealing element. The additional pressure on the sealing element allows the rotating BOP to be used for higher well bore pressures.

Prior art rotating BOPs have several drawbacks. One of the drawbacks is that the rotation of the drill pipe wears out the sealing element. The passage of pipe joints, down hole tools, and drill bits through the rotating BOP causes the sealing element to expand and contract repeatedly, which also causes the sealing element to become worn. When the sealing element becomes sufficiently worn, it must be replaced. Replacement of the sealing element can only occur when the drilling operations are stopped. Repeated stoppages in the drilling operations lower productivity because the well takes longer to drill. Increased longevity of the sealing element would result in fewer replacements and, thus, less down time and increased productivity. Therefore, a need exists for a rotating BOP with a sealing element having increased longevity.

U.S. Pat. No. 6,129,152 (the '152 patent) to Hosie, entitled "Rotating BOP and Method" discloses the use of bearings to allow the sealing element to rotate with the drill pipe. The bearings are subject to wear due to rotation. Thus, a need exists in the art for a rotating BOP design in which the lifetime of the bearings for the rotating sealing element is increased.

Some prior art rotating BOP's use a large number of ball bearings to reduce wear. But a rotating BOP using ball bearings requires that the rotating BOP be removed from the drilling site in order to replace the ball bearings. Thus, the prior art replacement method is time consuming and results in additional down time at the drilling site. If the rotating BOP could be "swapped out" with another unit, the reduction in downtime would mean greater productivity. Therefore, a need exists for a rotating BOP that is interchangeable and that may be engaged and disengaged rapidly.

An additional problem encountered with prior art rotating BOPs, including the '152 patent rotating BOP, is that the vertical height of the sealing element is increased to allow the sealing element to withstand higher pressures. API standards require an annular BOP to be used in the BOP stack below the rotating BOP. In extreme cases, the BOP stack can reach thirty feet in height. Drilling engineers are constantly seeking ways to decrease the height of the BOP stack. Decreasing the height of the sealing element for a given pressure rating would decrease the height of the rotating BOP, and thus decrease the height of the BOP stack. Consequently, a need exists for a sealing element that is shorter than prior art sealing elements while maintaining the same pressure differential as the prior art sealing elements.

SUMMARY OF THE INVENTION

The present invention, which meets the needs stated above, is a Rotating Pressure Control Head (RPCH) with a rapid engagement mechanism. The rapid engagement mechanism allows the upper body to be quickly disengaged from the lower body and replaced with a new upper body. The RPCH comprises an upper body and a lower body. The upper body comprises a sealing element and an inner housing that rotate with respect to an outer housing. The sealing element includes a plurality of internal cavities. The plurality of cavities in the sealing element control the constriction of the sealing element around the drill pipe. By controlling the constriction of the sealing element around the drill pipe, the sealing element is able to withstand higher well bore pressure than similarly sized sealing elements. Moreover, for a given well bore pressure, the sealing element of the present invention is shorter than the prior art sealing element designs. The combination of the shorter sealing element and the rapid engagement mechanism allows the RPCH to be significantly shorter than prior art rotating BOPs. Consequently, a BOP stack utilizing the RPCH is shorter than a BOP stack utilizing prior art rotating BOPs.

In the preferred embodiment, the sealing element rotates within the upper body. The preferred embodiment utilizes a plurality of bearings located at the uppermost and lowermost ends of the upper body. One set of bearings is configured to support the vertical load placed upon the upper body. A second set of bearings is configured to support the horizontal load placed upon the upper body. The position and division of workload between the first set of bearings and the second set of bearings decrease the harmonic vibrations at the extreme ends caused by the rotating drill pipe, thus increasing the service life of the bearings.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
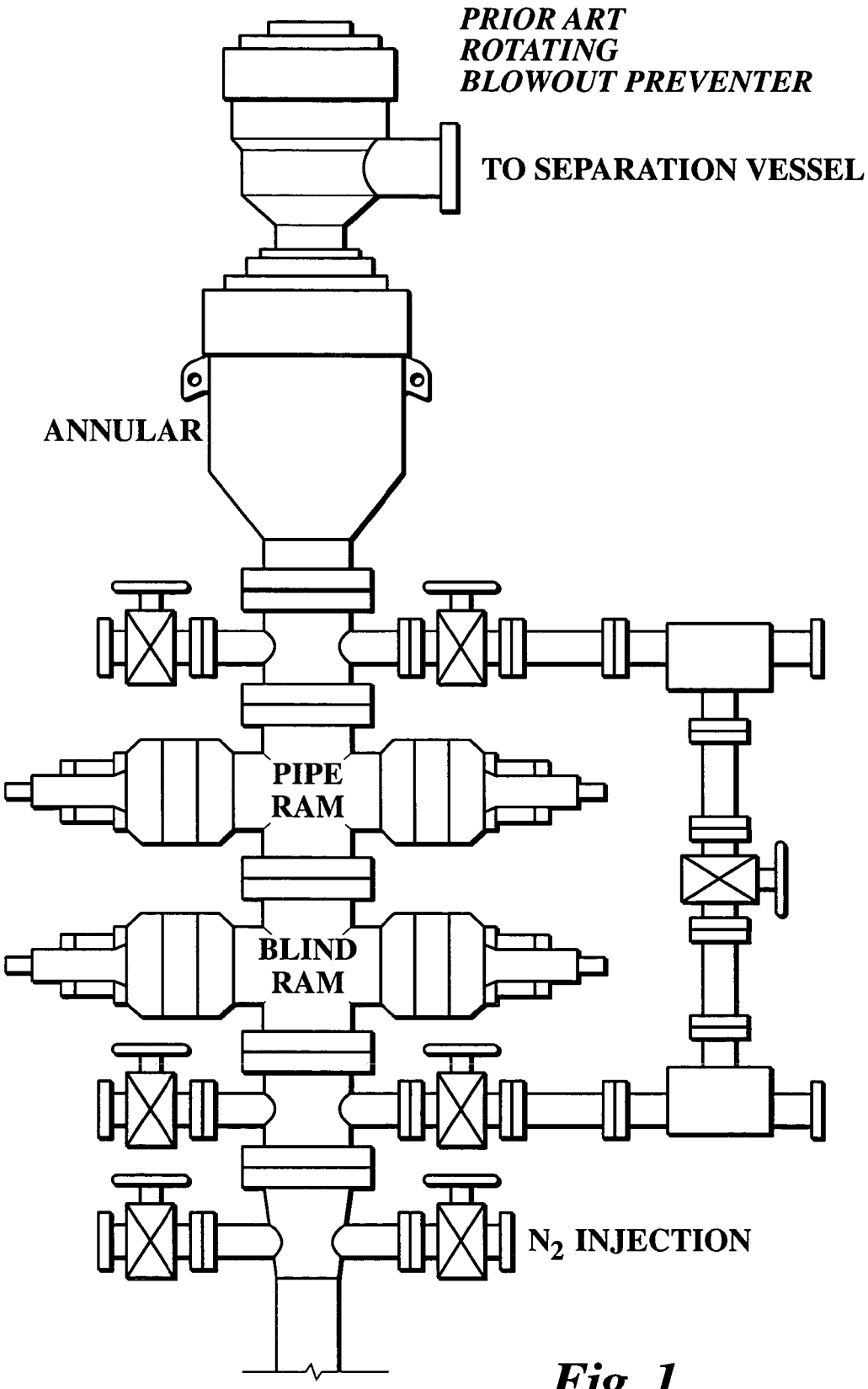
Fig. 1 ( PRIOR ART )
FIG. 1 is a prior art blowout control stack, including a rotating blowout preventer, a pipe ram, blind ram, and gas injection.
Figure 2:
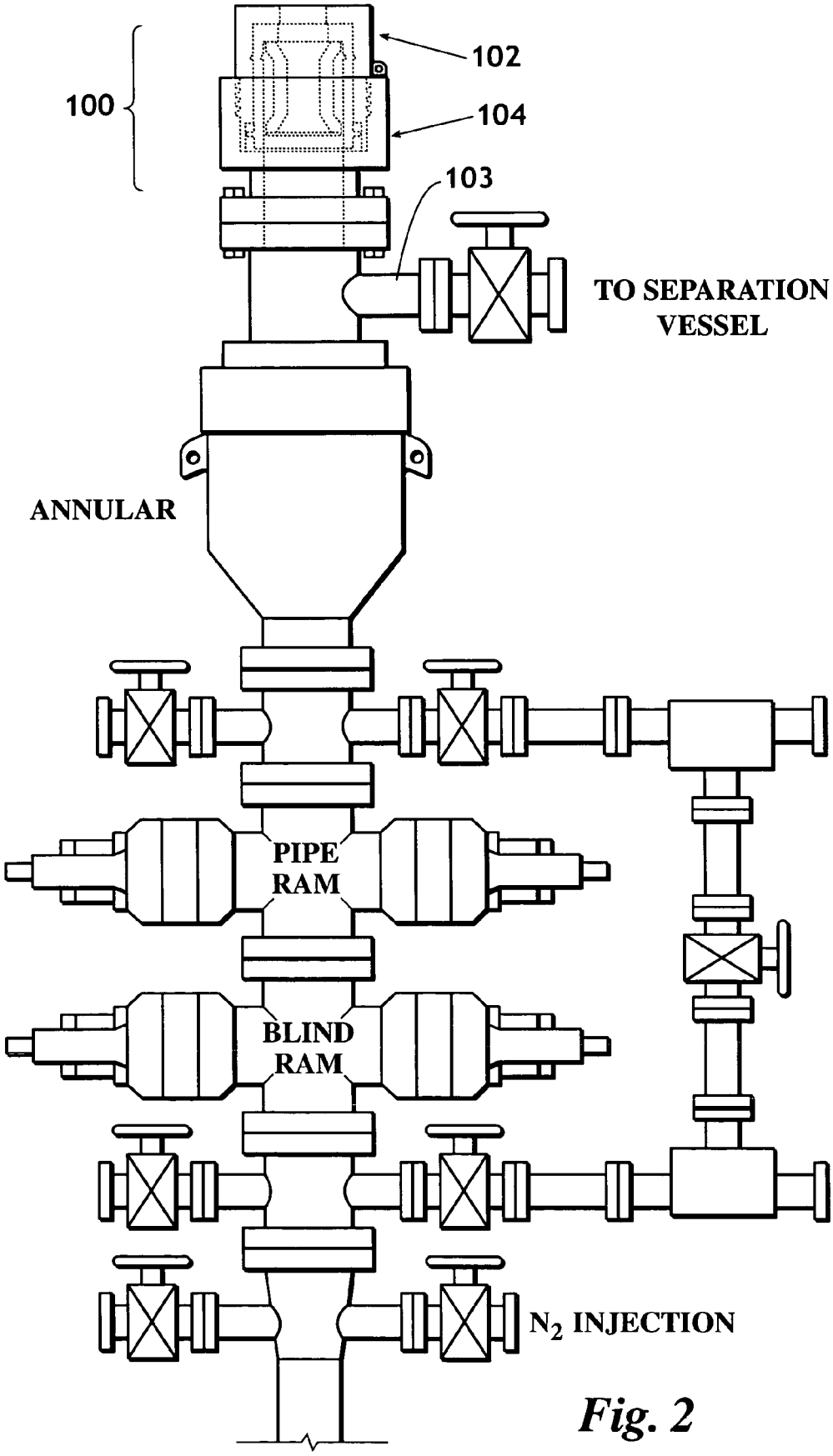
FIG. 2 is a blowout control stack with a Rotating Pressure Control Head, an annular ram, a blind ram, and gas injection.

FIG. 2 is an illustration of a blowout control stack employing the present invention, the Rotating Pressure Control Head (RPCH) 100, in place of the prior art rotating BOP shown in FIG. 1. RPCH 100 is affixed to a stack including a prior art annular ram, a prior art blind ram, a prior art pipe ram, and prior art gas injection. Persons of ordinary skill in the art will also appreciate the fact that RPCH 100 may replace not only the prior art rotating BOP, but the annular ram, the blind ram, and optionally the pipe ram when the well bore pressure does not exceed 1,500 psi. Utilization of the present invention to replace the prior art rotating BOP, the annular ram, the blind ram, and the pipe ram significantly reduces the height of the BOP stack. RPCH 100 has upper body 102 and lower body 104. Moreover, as discussed further below (see FIG. 19 through FIG. 21), lower body 104 may be modified to include outlet 103 for connection to a separation vessel.

Figure 3:
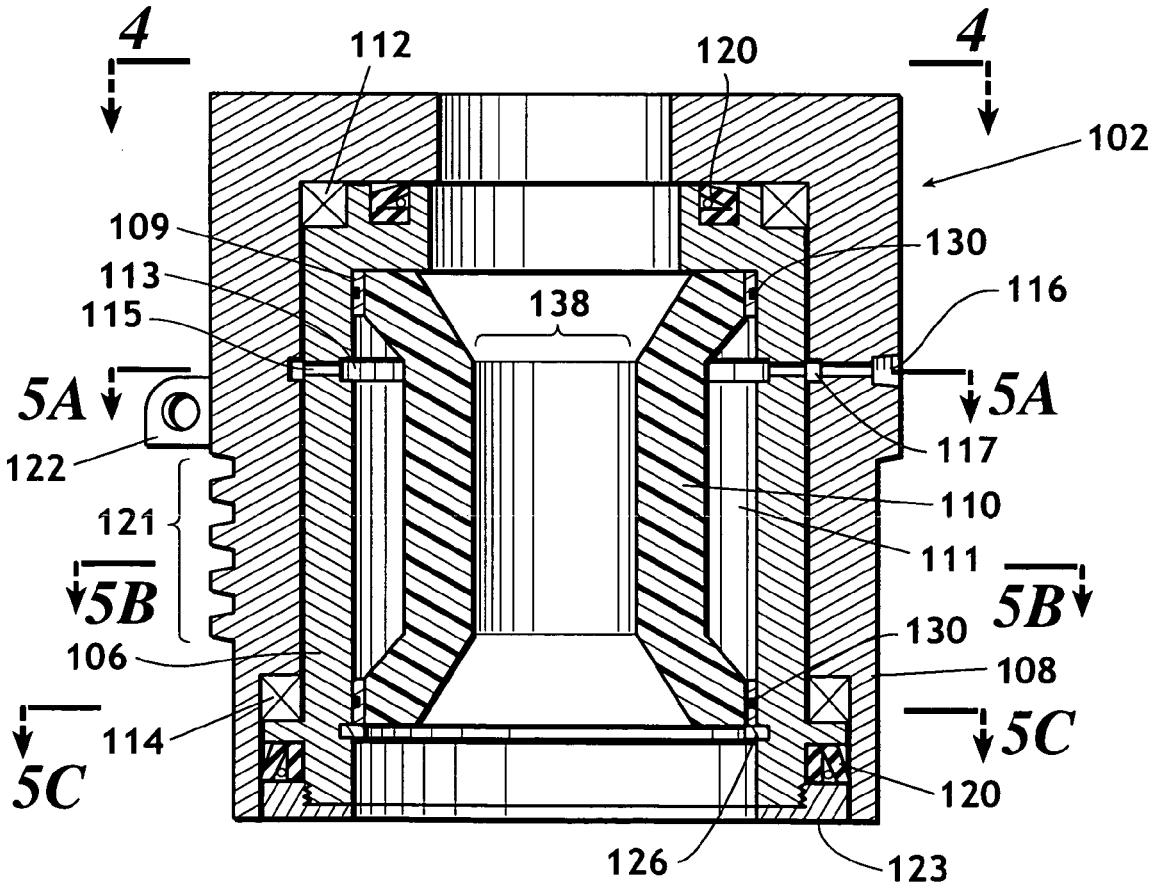
FIG. 3 is a cross-sectional elevation view of the upper body.

FIG. 3 is a cross-sectional elevation view of upper body 102. Upper body 102 comprises outer housing 108, inner housing 106, sleeve 109, sealing element 110, and retaining ring 126. A plurality of upper rapid engagement threads 121 are located on the lowermost portion of the exterior of outer housing 108. The upper rapid engagement threads 121 mate up with a plurality of lower rapid engagement threads 118 on lower body 104 (not shown in FIG. 3). Outer housing 108 also contains locking tab 122, which mates up with locking tab 122 on lower body 104. Port 116 is an aperture located in outer housing 108.

Inner housing 106 rotates within outer housing 108. Upper bearing 112 supports the vertical loads placed upon inner housing 106. Lower bearing 114 supports the horizontal loads placed upon inner housing 106. If necessary, another bearing may be located on the upper portion of inner housing 106 to further support the horizontal load placed upon inner housing 106. First seals 120 are located on either side of upper bearing 112 and lower bearing 114. First seals 120 keep upper bearing 112 and lower bearing 114 sufficiently lubricated to minimize frictional wear on upper bearing 112 and lower bearing 114. Inner housing 106 also contains first channel 117 that connects port 116 in outer housing 108 to each of cavities 111 in sealing element 110. Bottom 123 attaches to inner housing 106 by threaded engagement, or by any other suitable means know to persons skilled in the art.

Sealing element 110 is located within sleeve 109. Sleeve 109 is located within inner housing 106. Sleeve 109 is held in place by inner housing 106 and retaining ring 126. Sleeve 109 is bonded to sealing element 110 and is adapted to facilitate the insertion and removal of sealing element 110 from inner housing 106. Inner housing 106 has second seals 130 between sealing element 110 and inner housing 106. Sealing element 110 contains a plurality of cavities 111. Port 116 and first channel 117 are arranged such that hydraulic fluid (not shown) may pass through port 116, first channel 117, channel ports 115 (see also FIG. 5A), second channel 113 (see also FIG. 5A) and into cavities 111 in sealing element 110 when sealing element 110 and inner housing 106 are rotating with respect to outer housing 108. The hydraulic fluid also enters the slight space between outer housing 102 and inner housing 106 from first channel 117 to provide lubrication for rotating inner housing 106.

Figure 4:
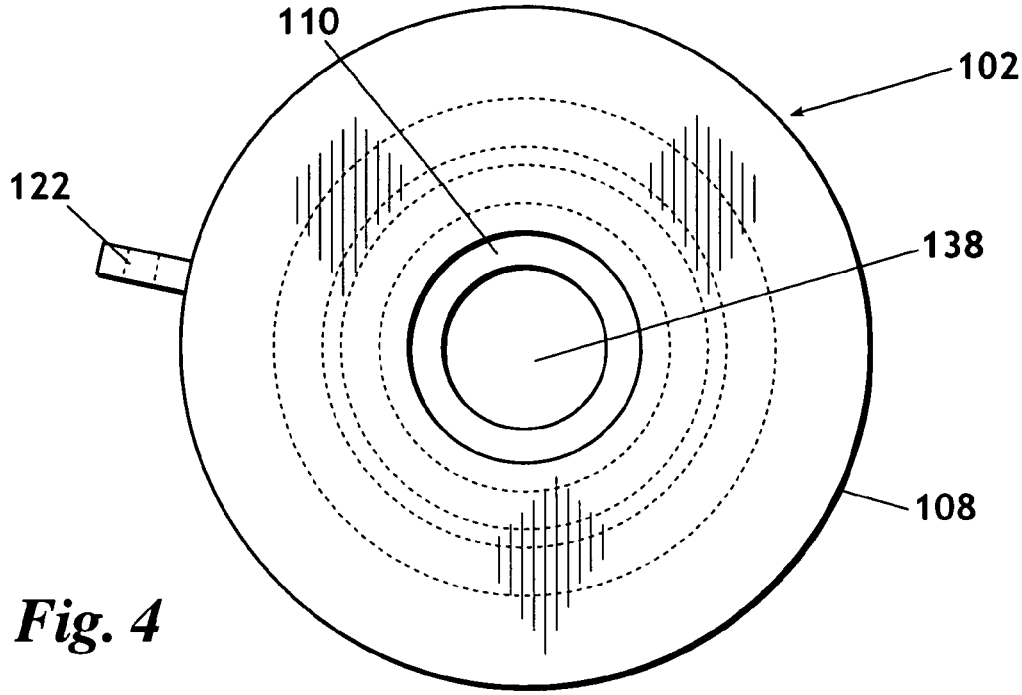
FIG. 4 is a plan view of the upper body taken along line 4-4 in FIG. 3.

FIG. 4 is a plan view of upper body 102 taken along line 4-4 in FIG. 3. Locking tab 122 can be seen in FIG. 3. As seen in FIG. 3, cylindrical aperture 138 exists along the central axis of outer housing 108, inner housing 106, sealing element 110, and retaining ring 126. Cylindrical aperture 138 allows the drill pipe to pass through upper body 102. Under normal operating conditions, the inside diameter of cylindrical aperture 138 in sealing element 110 is less than the inside diameter of the apertures in outer housing 108.

This configuration allows sealing element 110 to form a seal around the drill pipe (not shown) without the drill pipe contacting outer housing 108. However, sealing element 110 is constructed of a flexible material and may expand until the sealing element 110 inside diameter is the same as the inside diameter of aperture in outer housing 108. When sealing element 110 expands, a drill bit or a down hole tool may pass completely though upper body 102.

Figure 5A:
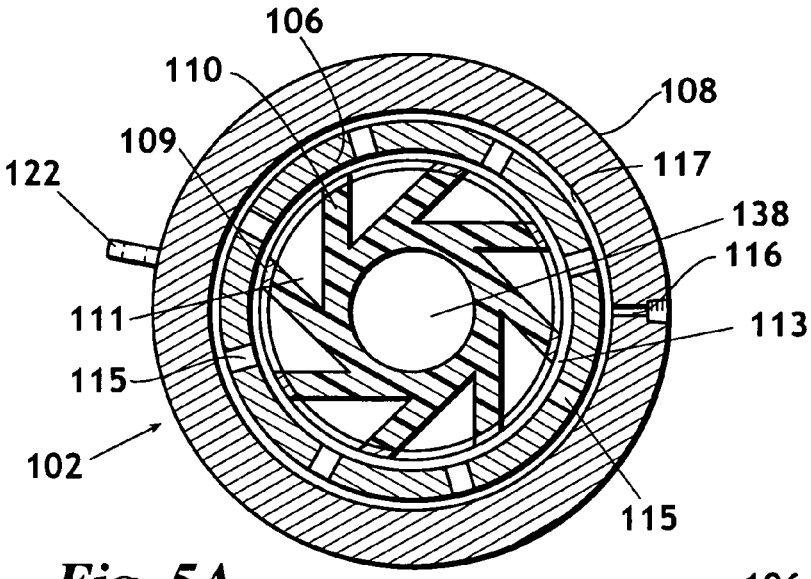
FIG. 5A is a cross-sectional plan view of the upper body taken along line 5A-5A in FIG. 3.
Figure 5B:
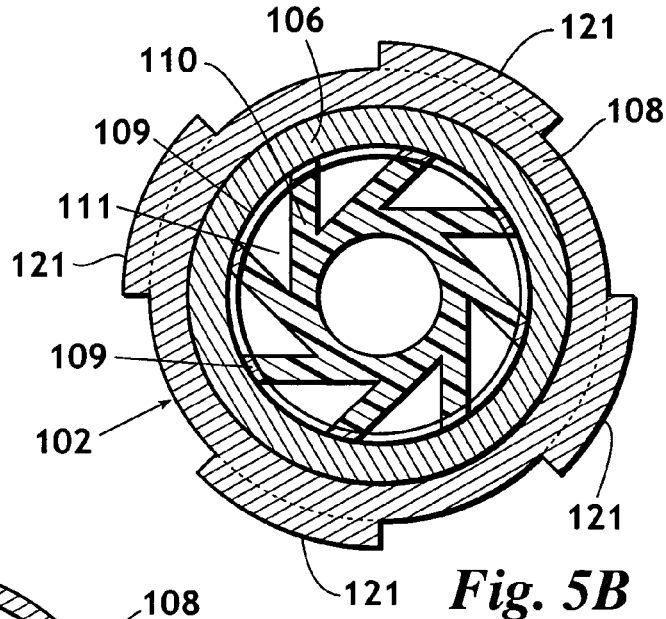
FIG. 5B is a cross-sectional plan view of the upper body taken along line 5B-5B in FIG. 3.
Figure 5C:
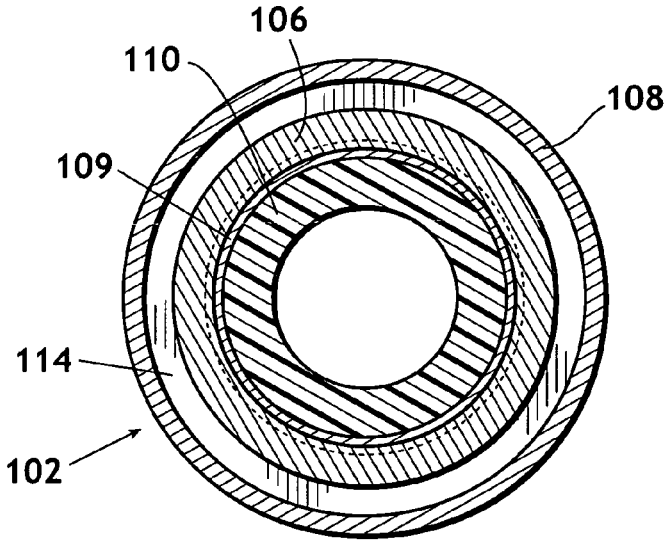
FIG. 5C is a cross-sectional plan view of the upper body taken along line 5C-5C in FIG. 3.

FIG. 5A is a cross-sectional plan view of upper body 102 taken along line 5A-5A in FIG. 3, FIG. 5B is a cross-sectional plan view of upper body 102 taken along line 5B-5B in FIG. 3, and FIG. 5C is a cross-sectional plan view of upper body 102 taken along line 5C-5C in FIG. 3. FIGS. 5A, 5B, and 5C illustrate the shape and connective details of upper body 102, particularly sealing element 110. FIG. 5A illustrates the connection between port 116 in outer body 108, first channel 117 in inner housing 106, and cavity 111 in sealing element 110. Locking tab 122 is also shown in FIG. 5A. FIG. 5B illustrates the shape of cavities 111 in sealing element 110. FIG. 5B also illustrates inner housing 106, sleeve 109, sealing element 110, outer housing 108, and upper rapid engagement threads 121. FIG. 5C illustrates inner housing 106, sleeve 109, sealing element 110, and outer housing 108. Sealing element 110 may be formed in any number of ways known to persons skilled in the art. In the preferred embodiment, sealing element 110 is formed by pouring liquid urethane into a cylinder containing a mold, and then removing the mold after the urethane has set in the desired configuration. After removing the top and bottom of the cylinder, and after cutting apertures in the cylinder to expose the internal cavities of the sealing element, the cylinder becomes sleeve 109. Persons skilled in the art will be aware of other methods of forming sealing element 110, and that sealing element 110 may be formed from rubber, thermoplastic rubber, plastic, urethane or any other elastomer or elastometric material possessing the required properties.

The introduction of pressurized hydraulic fluid into cavities 111 within sealing element 110 causes sealing element 110 to expand inwardly to form a pressure retaining seal on the drill pipe. Pressurized hydraulic fluid flows through port 116 and into first channel 117. From first channel 117, the pressurized hydraulic fluid flows through a plurality of channel apertures 115 into second channel 113 and into cavities 111 (see also FIG. 15A and FIG. 15B). The shape of cavities 111 is such that cavities 111, inner housing 106, and sleeve 109 cause sealing element 110 to constrict against the drill pipe in a controlled and predictable manner. Unlike prior art sealing elements that fold, twist, wrinkle, and bend in unpredictable manners as they are forced onto the rotating drill pipe, the inner wall of sealing element 110 twists as sealing element 110 expands inwardly. The twisting action of sealing element 110 results in a pressure seal between the drill pipe and sealing element 110 that is sufficient for almost any drilling application.

Persons of ordinary skill in the art will appreciate that the pressurization of cavities 111 by a hydraulic fluid may be supplemented or substituted by pressure from the drilling or production fluid. In such an embodiment, cavities 111 may be partially or fully exposed to the drilling or production fluid. For example, in an alternate embodiment, cavities 111 may be open at the bottom so that a cross section taken at the bottom of sealing element 110 may be the same as the cross section of sealing element 110 depicted in FIG. 5B. Alternatively, access to cavities 111 may be through apertures (not shown) in the bottom of sealing element 110. In such embodiments, as a minimum, port 116 would be closed. Moreover, in such embodiments, inner housing 106 may be manufactured without channel ports 115 and second channel 113 thereby preventing drilling fluid from entering the slight space between inner housing 106 and outer housing 102. Furthermore, such embodiments permit port 116 to remain open for introduction of hydraulic fluid through port 116 and first channel 117 to lubricate the space between inner housing 106 and outer housing 102.

The seal between sealing element 110 and the drill pipe is sufficiently strong that the vertical height of sealing element 110 may be less than the height required by prior art sealing elements. As an example, the prior art rotating BOPs require a sealing element that is as much as fifty inches in vertical height. The present invention's sealing element 110 can maintain the same pressure with only fifteen inches of vertical height. The shorter sealing element means that RPCH 100 is shorter, thus reducing the overall height of the stack.

Another advantage of the present invention is that sealing element 110 can completely close off the well bore. When the drill pipe is removed from the center section of sealing element 110, a pressurized hydraulic fluid can be introduced into cavities 111 to cause the inner wall of sealing element 110 to constrict onto itself, closing off the well bore. In this application, sealing element 110 is able to perform the same function as an annular BOP or blind ram and can withhold well bore pressures of up to 1,500 psi. If the present invention is fitted with a mechanism that positions a plate over the aperture in upper body 102 such that the plate contacts sealing element 110, then the present invention can withstand almost any pressure encountered in drilling applications.

Figure 6:
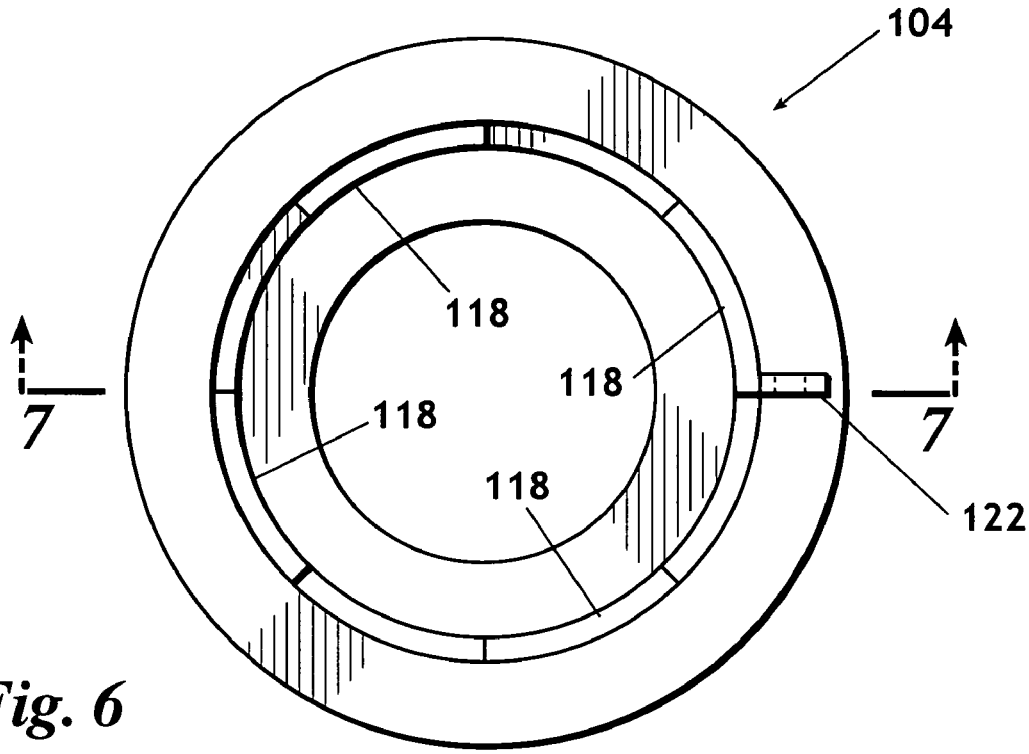
FIG. 6 is a plan view of the lower body.
Figure 7:
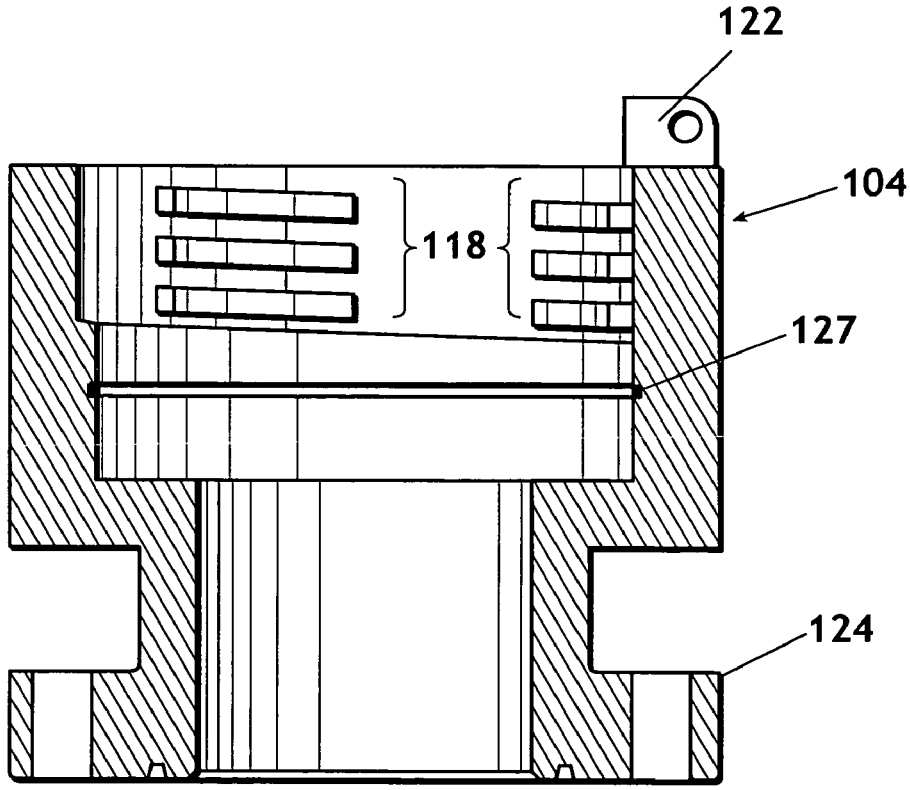
FIG. 7 is a cross-sectional elevation view of the lower body taken along line 7-7 in FIG. 6.

FIG. 6 is a plan view of lower body 104. Lower body 104 comprises locking tab 122, and lower rapid engagement threads 118. Lower rapid engagement threads 118 on lower body 104 mate up with upper rapid engagement threads 121 on upper body 102. When lower rapid engagement threads 118 on lower body 104 are engaged with upper rapid engagement threads 121 on upper body 102, locking tab 122 on lower body 104 mates up with locking tab 122 on upper body 102. A lock or other device may be placed through locking tabs 122 to prevent accidental disengagement of upper body 102 and lower body 104. Flange connection 124 connects lower body 104 to the remainder of the stack shown in FIG. 2. FIG. 7 is a cross-sectional elevation view of the lower body 104 taken along line 7-7 in FIG. 6. The orientation of locking tab 122, lower rapid engagement threads 118, flange connection 124 and third seal 127 can be clearly seen in FIG. 7.

Figure 8:
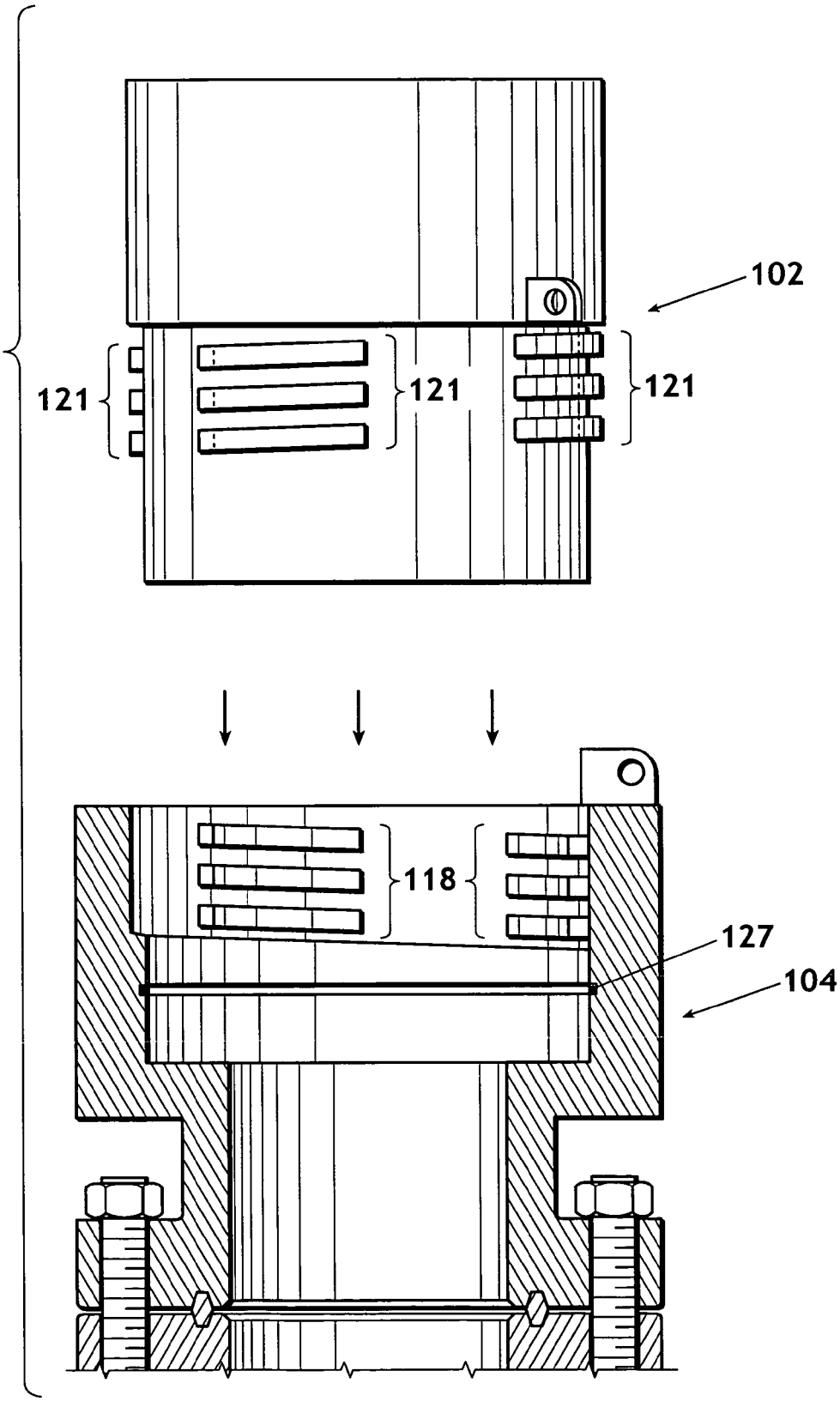
FIG. 8 is an elevation view of the alignment of the upper body and the lower body.

The present invention is designed such that upper body 102 may be quickly removed and replaced. The rapid engagement mechanism described herein allows a drilling operator to turn an old upper body 102 a small amount, remove the old upper body 102, align a new upper body 102 with lower body 104, insert the new upper body 102 into lower body 104, and secure the new upper body 102 to lower body 104. FIGS. 8-14 illustrate the aligning, inserting, and securing steps of the present invention. FIG. 8 is an elevation view of the alignment of upper body 102 and lower body 104 (lower body 104 shown in cross-section). The alignment step occurs when a user aligns upper body 102 with lower body 104. Upper body 102 is properly aligned with lower body 104 when upper rapid engagement threads 121 in upper body 102 align with the spaces between lower rapid engagement threads 118 in lower body 104, and vice-versa. Rapid engagement and disengagement of upper body 102 is achieved using the same principle of speed and strength used in the design of breech blocks for breech loading artillery.

Figure 9:
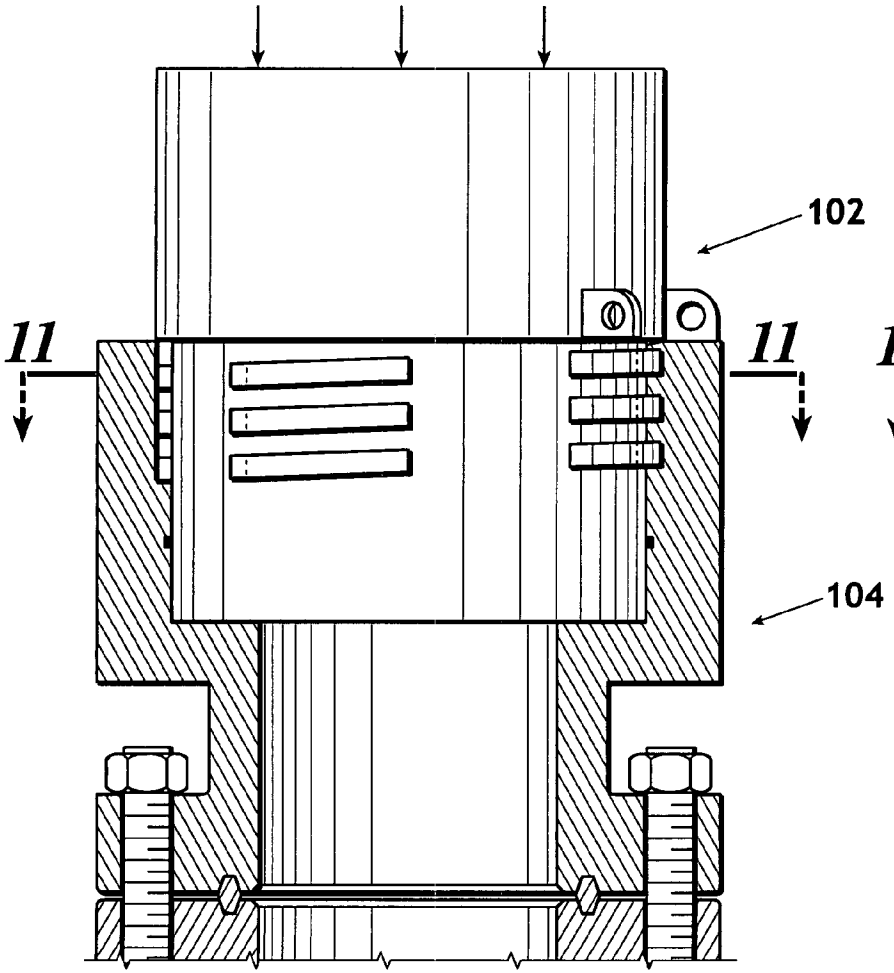
FIG. 9 is an elevation view of the insertion of the upper body into the lower body.
Figure 11:
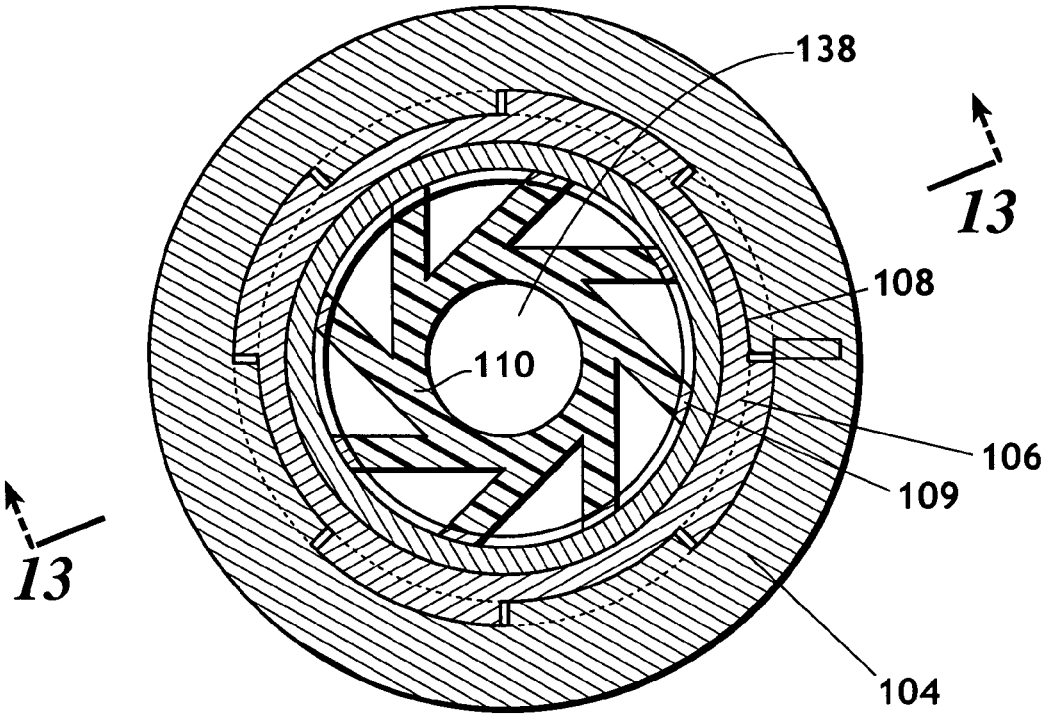
FIG. 11 is a cross-sectional plan view of the insertion of the upper body into the lower body taken along line 11-11 in FIG. 9.
Figure 13:
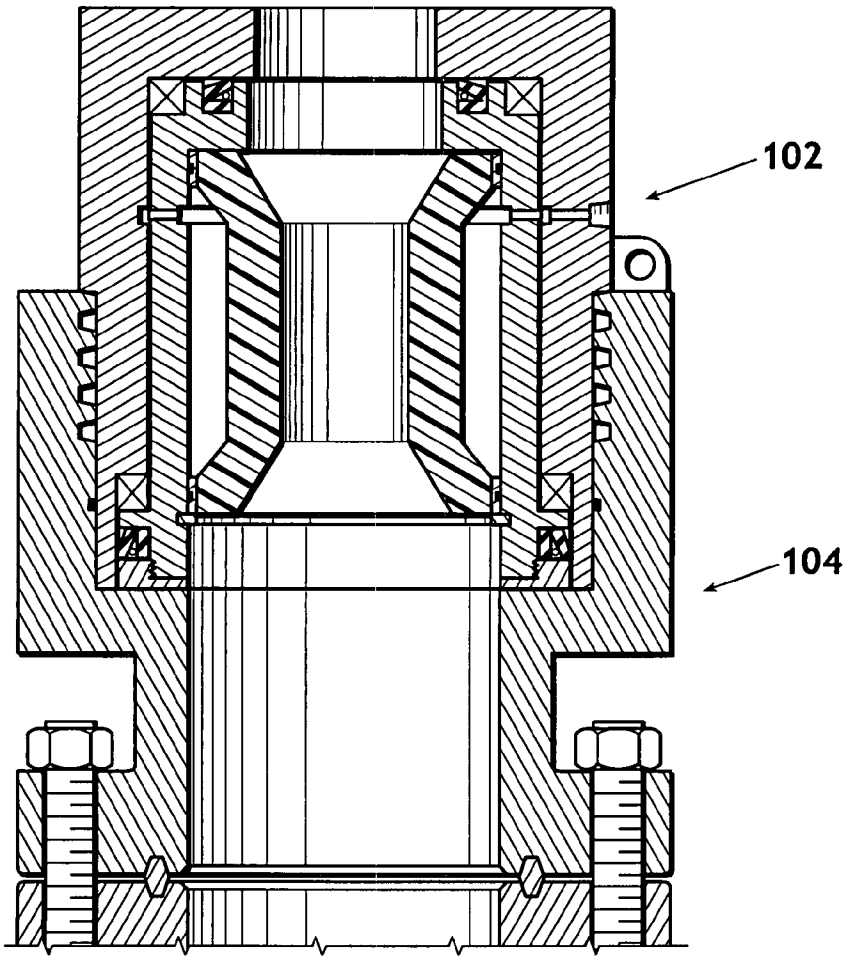
FIG. 13 is a cross-sectional elevation view of the insertion of the upper body into the lower body taken along line 13-13 in FIG. 11.

FIG. 9 is an elevation view of the insertion of upper body 102 into lower body 104 (lower body 104 shown in cross-section). The insertion step occurs when the lower section of upper body 102 is inserted into the upper section of lower body 104. In the insertion step, upper rapid engagement threads 121 on upper body 102 are aligned with, but have not yet engaged with, lower rapid engagement threads 118 on lower body 104. FIG. 11 is a cross-sectional plan view of the insertion of upper body 102 into lower body 104 taken along line 11-11 in FIG. 9. FIG. 13 is a cross-sectional elevation view of the insertion of upper body 102 into lower body 104 taken along line 13-13 in FIG. 11 after the rotation of upper body 102. Both FIGS. 11 and 13 show movement of upper rapid engagement threads 121 on upper body 102 aligned with, but not engaged with, lower rapid engagement threads 118 on lower body 104.

Figure 10:
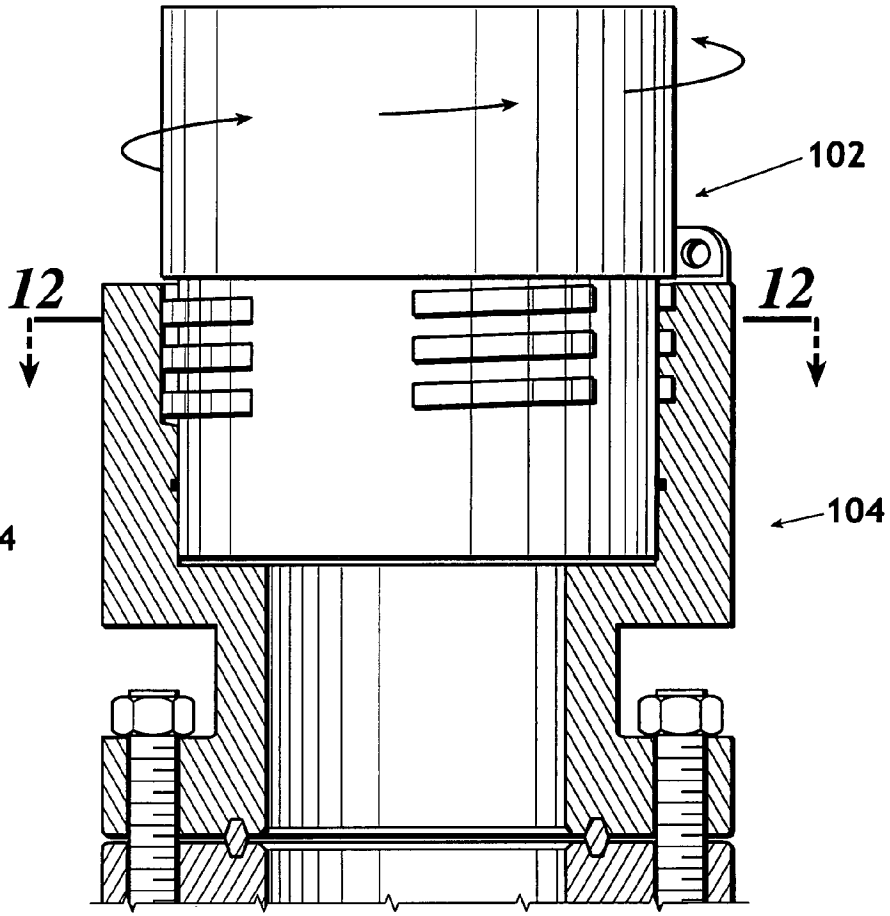
FIG. 10 is an elevation view of the securement of the upper body to the lower body.
Figure 12:
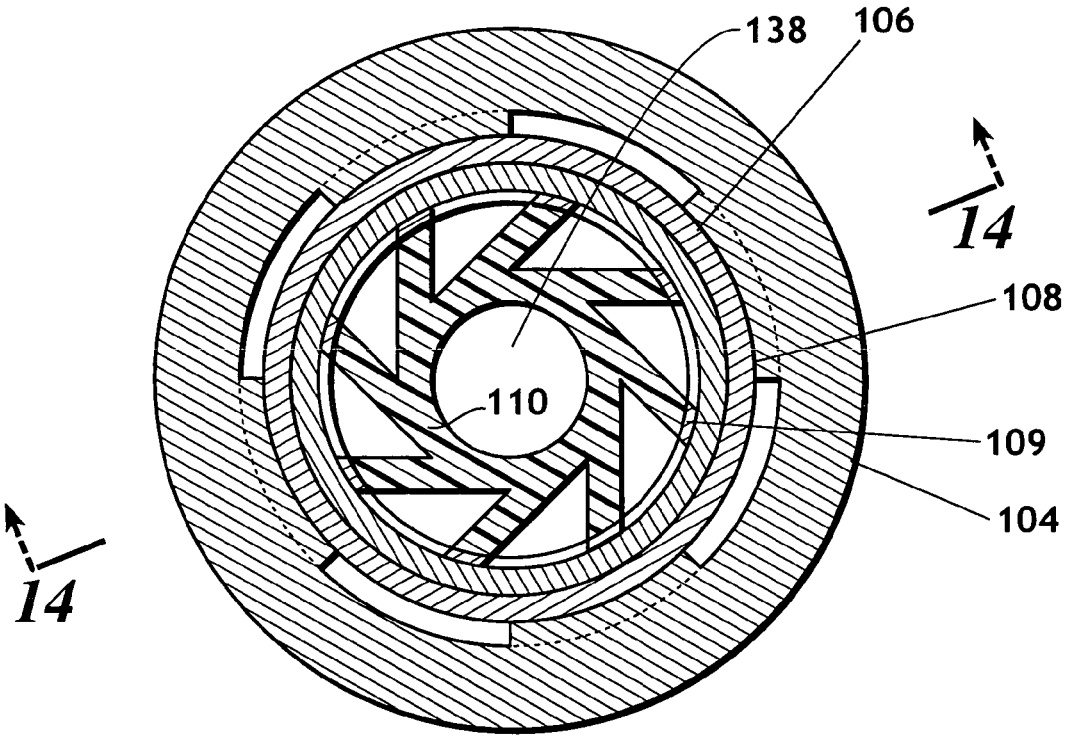
FIG. 12 is a cross-sectional plan view of the securement of the upper body to the lower body taken along line 12-12 in FIG. 10.
Figure 14:
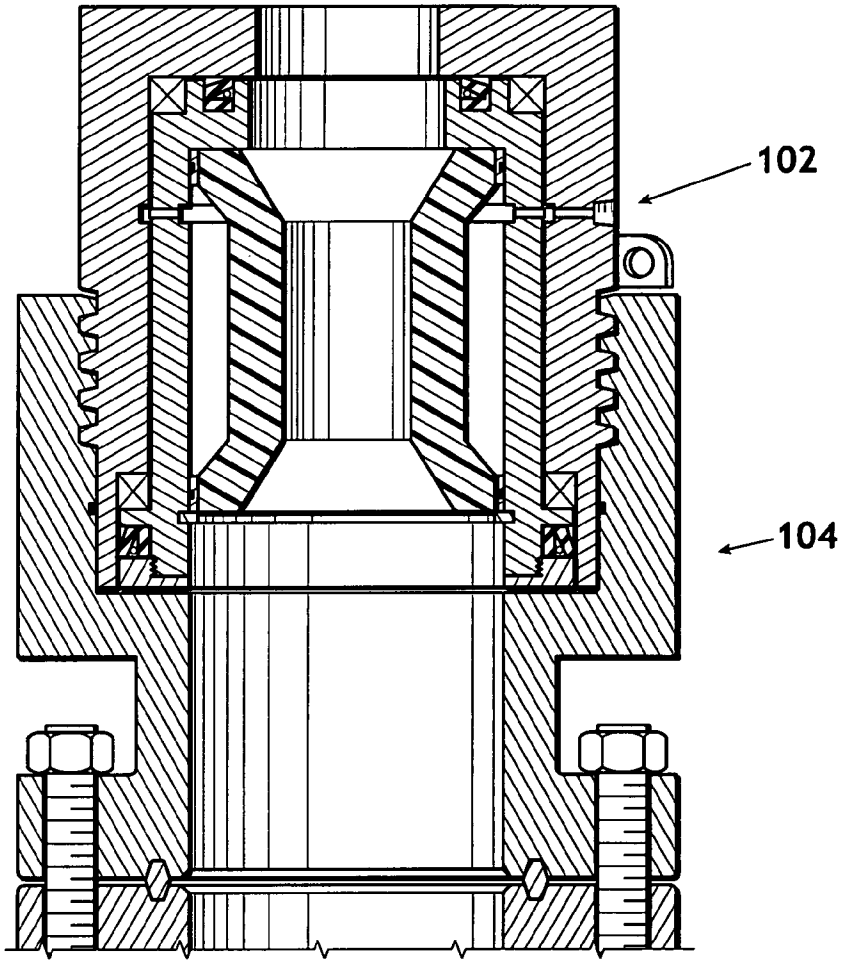
FIG. 14 is a cross-sectional elevation view of the securement of the upper body to the lower body taken along line 14-14 in FIG. 12.

FIG. 10 is an elevation view of the securement of upper body 102 to lower body 104 (lower body 104 shown in cross-section). The securement step occurs when upper body 102 is secured to lower body 104. In the securement step, upper rapid engagement threads 121 on upper body 102 engage lower rapid engagement threads 118 on lower body 104. Upper body 102 may be rotated as little as twenty degrees or as much as forty-five degrees to sufficiently engage lower body 104. FIG. 12 is a cross-sectional plan view of the securement of upper body 102 to lower body 104 taken along line 12-12 in FIG. 10. FIG. 14 is a cross-sectional elevation view of the securement of upper body 102 to lower body 104 taken along line 14-14 in FIG. 12. Both FIGS. 12 and 14 show upper rapid engagement threads 121 on upper body 102 engaged with lower rapid engagement threads 118 on lower body 104.

Figure 15A:
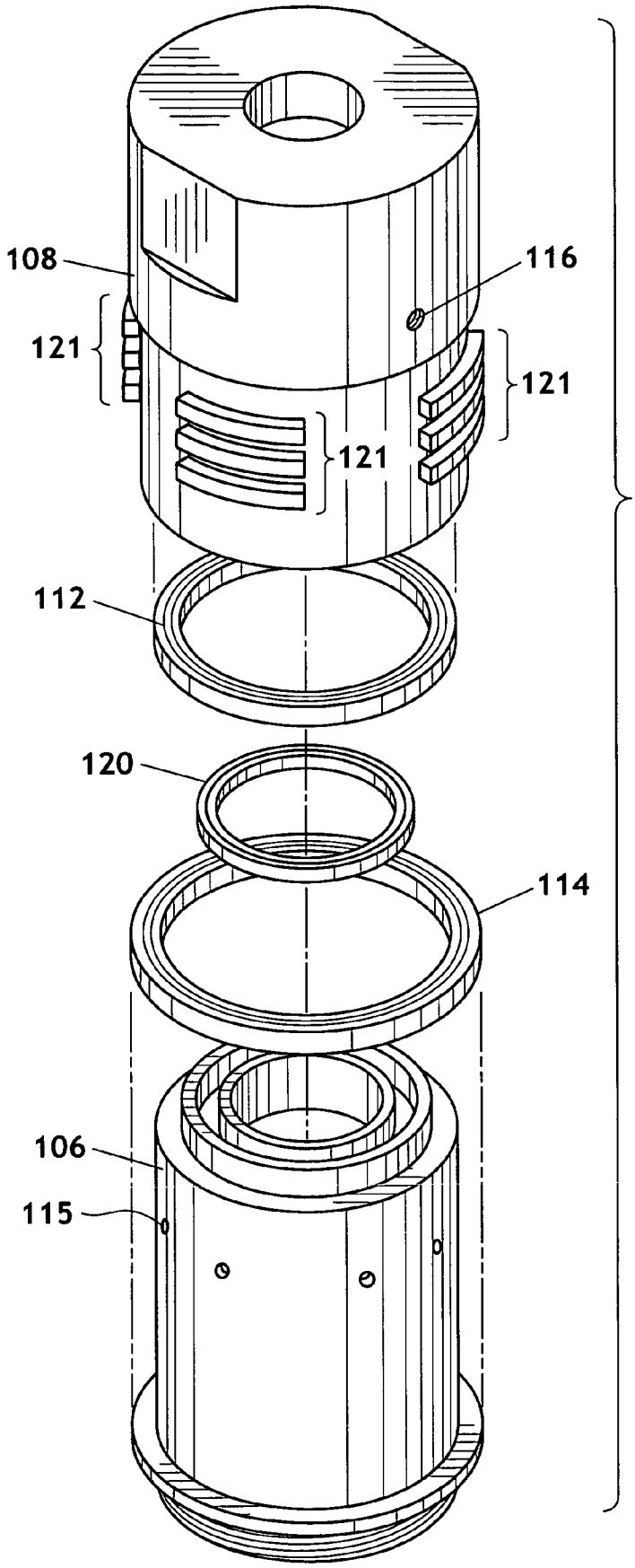
FIGS. 15A and B are an exploded view of the present invention.
Figure 15B:
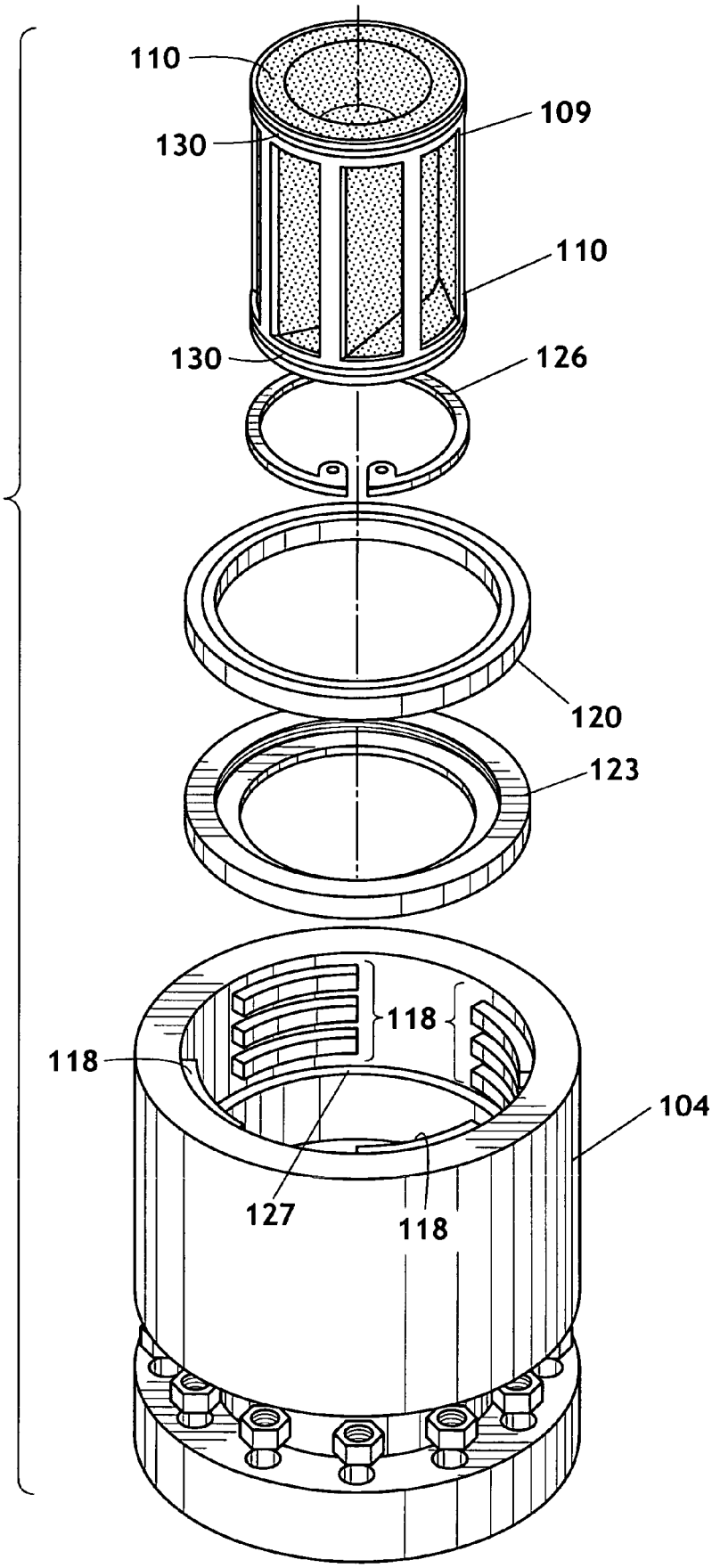

FIGS. 15A and 15B are an exploded view of the present invention. FIG. 15A illustrates the connection of most of the parts of upper body 102, including outer housing 108, upper bearing 112, first seals 120, lower bearing 114, and inner housing 106. FIG. 15B illustrates the remaining parts of upper body 102: sealing element 110, sleeve 109 and retaining ring 126. FIG. 15B also illustrates lower body 104 including flange connection 124 (see FIG. 7) and the hex nuts used to secure flange connection 124 to the BOP stack (See FIG. 2).

Figure 17:
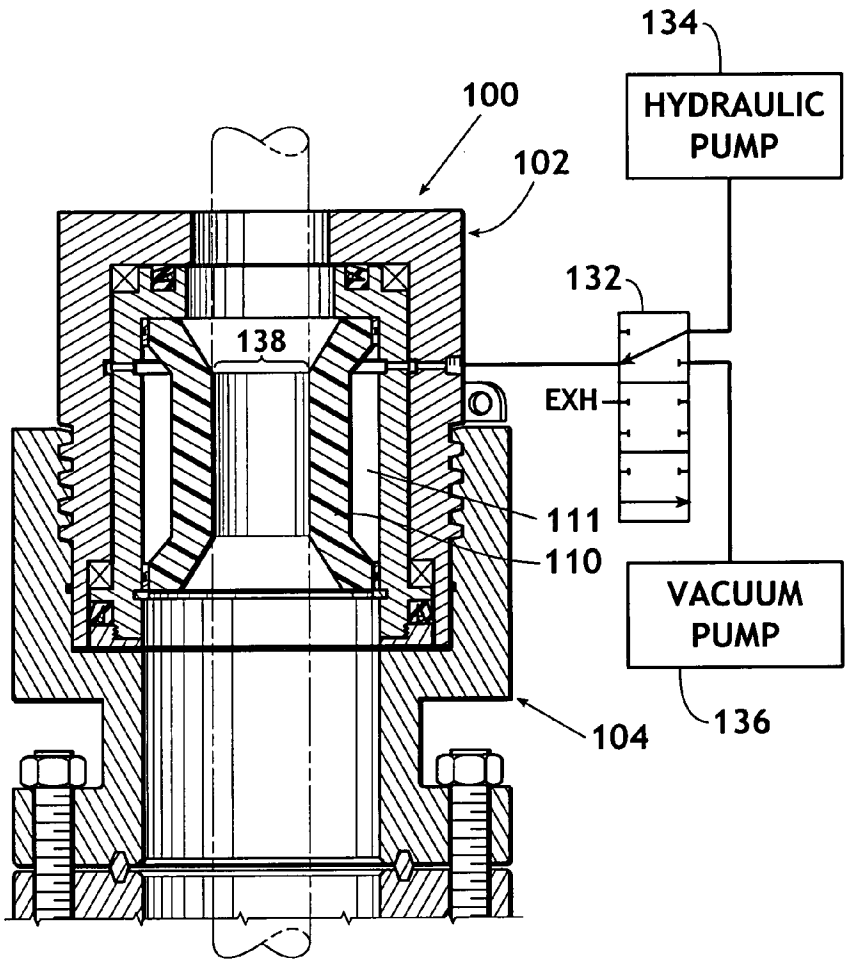
FIG. 17 is a cross sectional view of the present invention with the sealing element in a contracted position.
Figure 16:
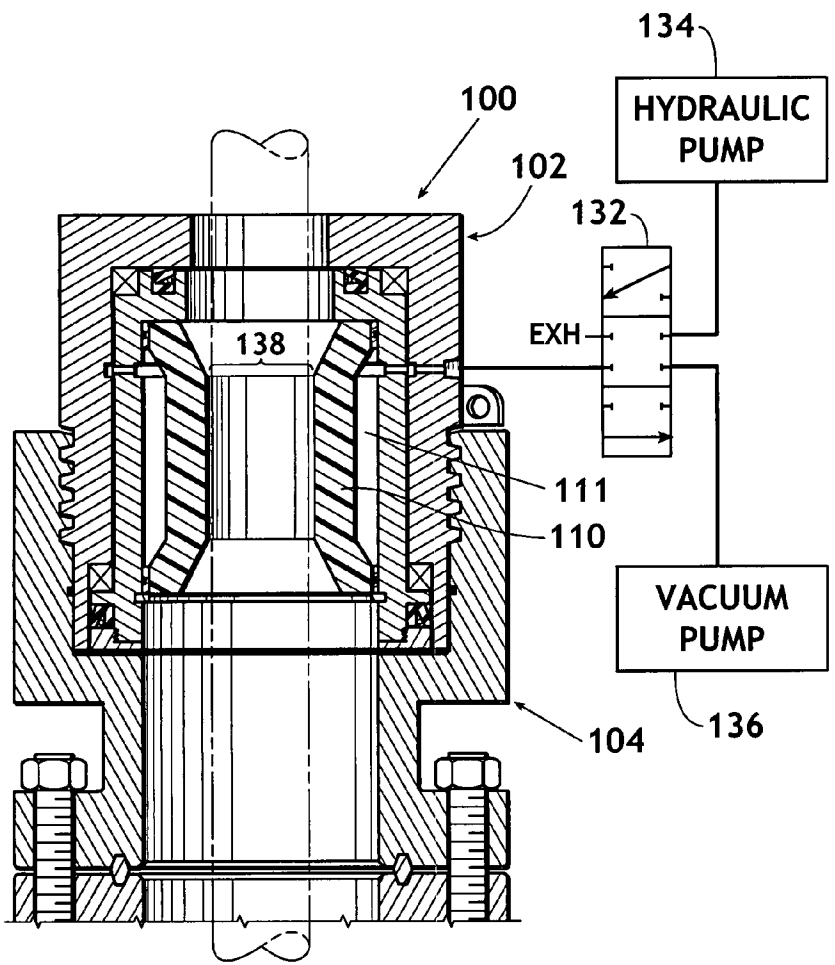
FIG. 16 is a cross sectional view of the present invention with the sealing element in a relaxed position.
Figure 18:
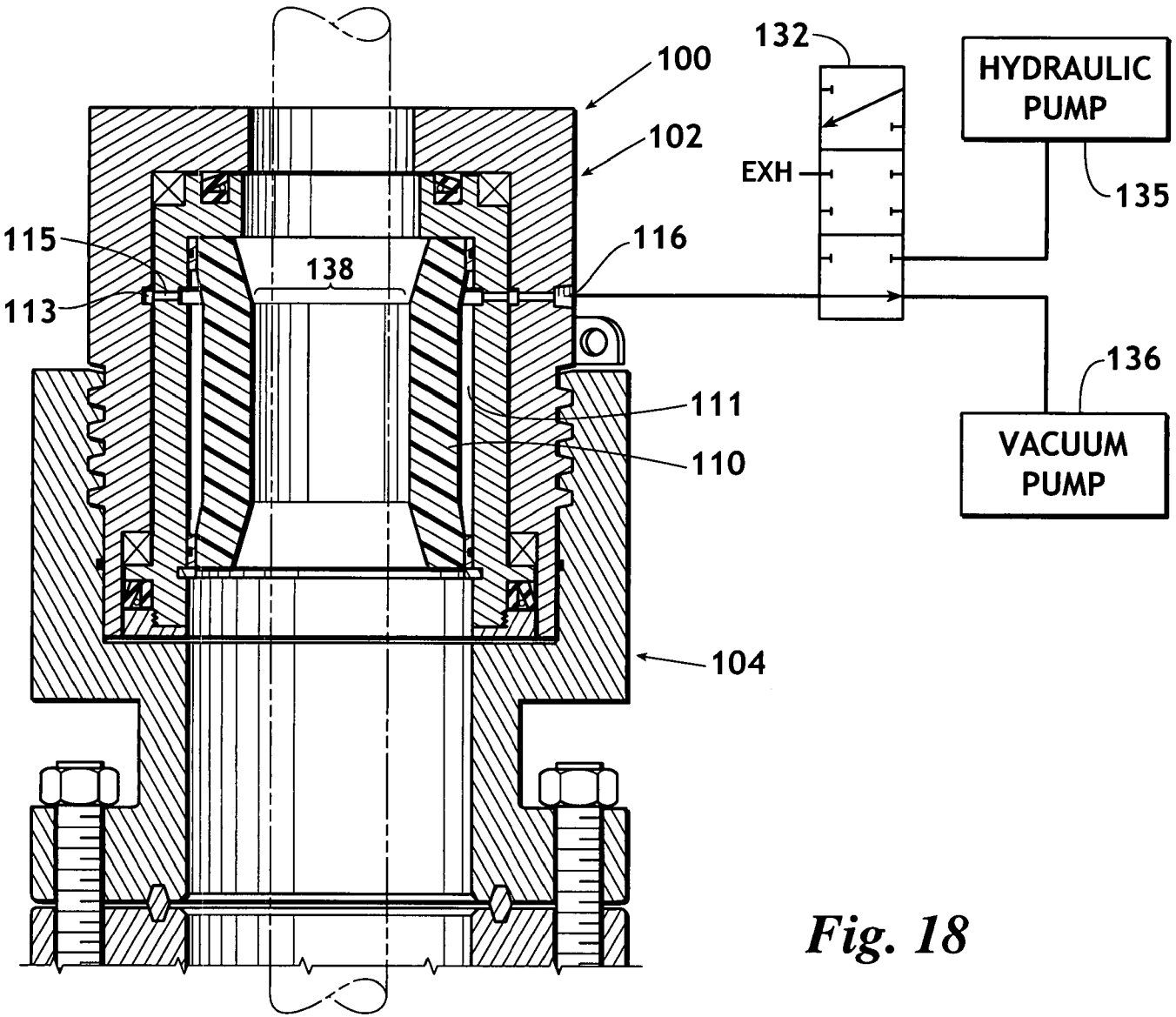
FIG. 18 is a cross sectional view of the present invention with the sealing element in an expanded position.

FIGS. 16 through 18 depict Rotating Pressure Control Head 100 connected to switch 132, hydraulic pump 134 and vacuum pump 136 so that positive or negative pressure can be applied to sealing element 110 by transmission of positive or negative pressure through port 116, first channel 117, channel apertures 115, and second channel 113 into cavity 111. Referring to FIG. 16, sealing element 110 is relaxed at atmospheric pressure since switch 132 is in a neutral position and neither positive nor negative pressure is being applied. Referring to FIG. 17, positive pressure is applied when switch 132 engages hydraulic pump 134 to pump fluid into cavities 111 to cause sealing element 110 to form a seal around a drill pipe, or if there is no drill pipe to close entirely. Referring to FIG. 18, negative pressure is applied when switch 132 engages vacuum pump 136 to lower the pressure in cavities 111 causing sealing element to move inwardly and expand cylindrical aperture 138. Applying negative pressure to expand cylindrical aperture 138 of sealing element 110 facilitates the passage of a drill bit or a down hole tool through upper body 102. Persons skilled in the art will be aware that the pressure applied to cavities 111 may be regulated by a valve (not shown), and that the valve may be operated manually, automatically in response to a sensor monitoring annular return pressure (not shown), or by a computer connected to the valve and to the sensor (not shown).

Figure 19:
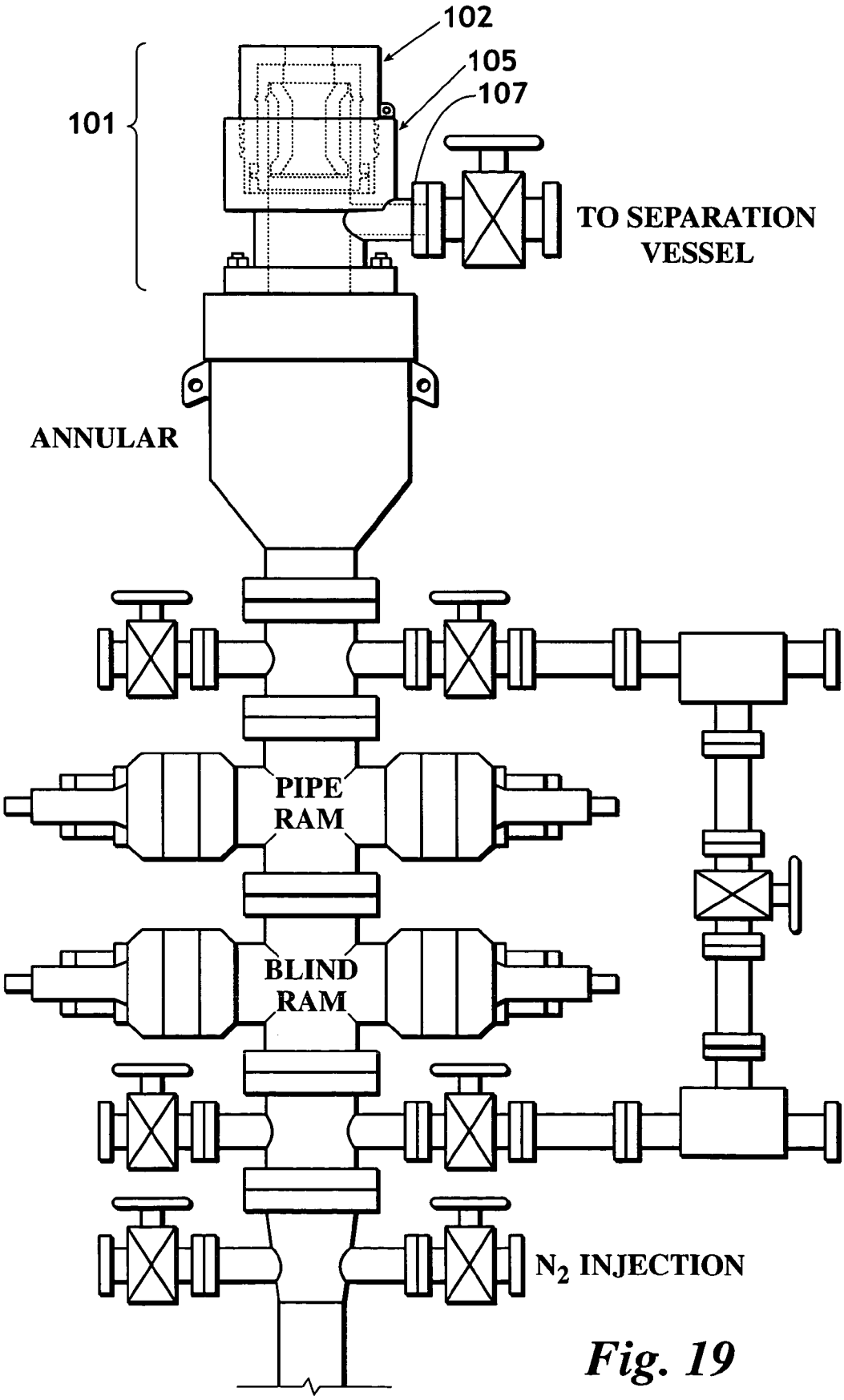
FIG. 19 is a blowout control stack with the Modified Rotating Pressure Control Head, an annular ram, a blind ram, and gas injection.
Figure 20:
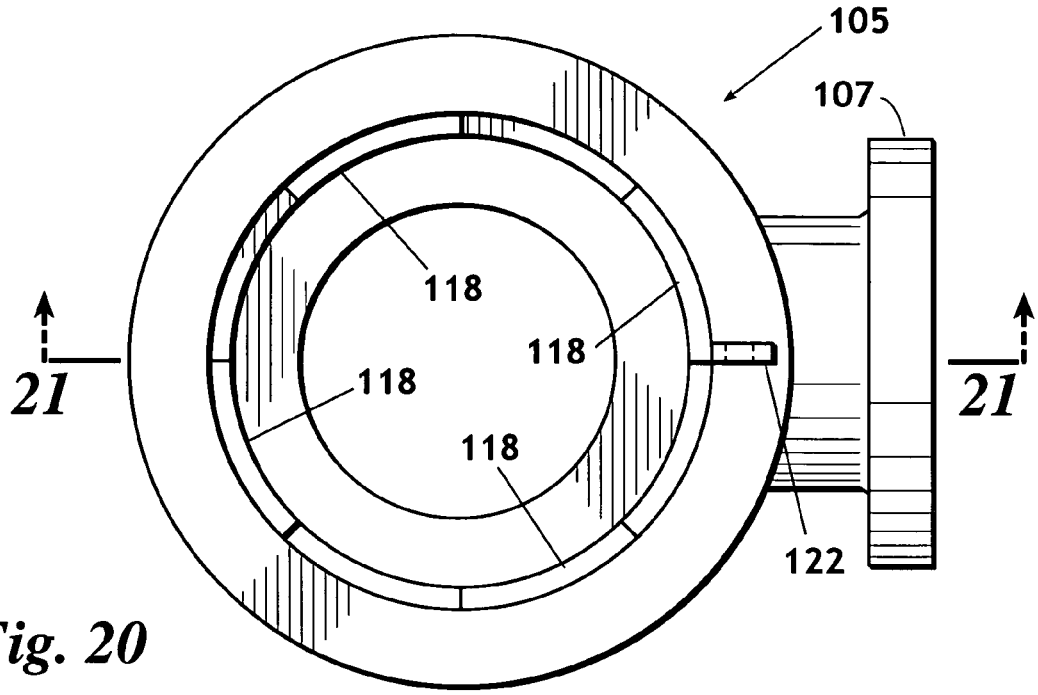
FIG. 20 is a plan view of the modified lower body.
Figure 21:
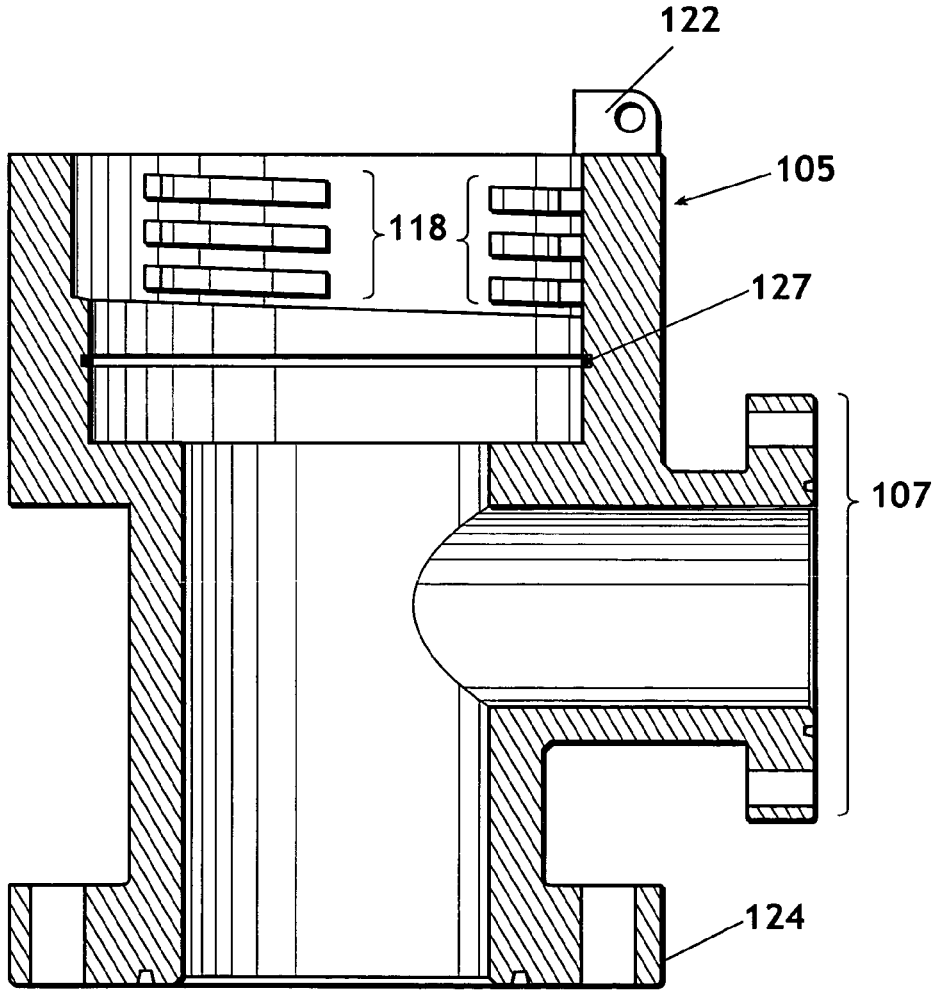
FIG. 21 is a cross sectional view of the modified lower body taken along line 21-21 in FIG. 20.

FIG. 19 through FIG. 21 depict Modified Rotating Pressure Control Head 101. Modified Rotating Pressure Control Head has modified lower body 105 and upper body 102 of Rotating Pressure Control Head 100. Modified lower body 105 has the same features as lower body 104, but has been enlarged and adapted for receiving outlet 107. Outlet 107 is adapted for engagement to a valve and pipe connected to a separation vessel. Modified Rotating Pressure Control Head 101 has the advantage that adding outlet 107 for connection to a separation vessel further decreases the overall height of the stack at the well head. The decrease in height is gained despite the fact that the height of modified lower body 105 is greater than the height of lower body 104 because the addition of outlet 107 to lower body 104 eliminates the need for a set of clamps for a separate outlet 103 (see FIG. 2).

While the preferred embodiment of the present invention utilizes a rotating sealing element 110, persons of ordinary skill in the art will appreciate that a stationary sealing element 110 may also be used. In the alternative embodiment, sealing element 110 is connected directly to outer housing 108 and the need for inner housing 106, upper bearing 112, lower bearing 114, and first seals 120 are eliminated. The alternative embodiment is simpler and less expensive to construct, but sealing element 110 has a shorter service life. Persons of ordinary skill in the art will know best which embodiment is preferable for individual applications.

With respect to the above description, it is to be realized that the optimum dimensional relationships for the parts of the invention, to include variations in size, materials, shape, form, function, manner of operation, assembly, and use are deemed readily apparent and obvious to one of ordinary skill in the art. The present invention encompasses all equivalent relationships to those illustrated in the drawings and described in the specification. The novel spirit of the present invention is still embodied by reordering or deleting some of the steps contained in this disclosure. The spirit of the invention is not meant to be limited in any way except by proper construction of the following claims.

What is claimed is:

1. A sealing element for creating a seal between a plurality of cylindrical members, the sealing element comprising:

a plurality of internal cavities;

a plurality of apertures for connecting the plurality of internal cavities to a pressurized fluid;

wherein inflation of the plurality of internal cavities by the pressurized fluid causes an inner wall of the sealing element to constrict the innermost cylindrical member in a twisting action.

2. The sealing element of claim 1 wherein the cavities are triangular when viewed in cross-section.

3. The sealing element of claim 1 wherein the inner wall of the sealing element does not wrinkle when the sealing element constricts the innermost cylindrical member.

4. The sealing element of claim 1 wherein the innermost cylindrical member is a drill pipe.

5. The sealing element of claim 1 wherein the sealing element is incorporated into a rotating pressure control head.

6. The sealing element of claim 1 wherein the sealing element is incorporated into a blowout preventer stack.

7. The sealing element of claim 1 wherein the sealing element is incorporated into a rotating pressure control head adapted for engagement to a separation vessel.

8. A sealing element comprising:

a substantially cylindrical outer surface;

a substantially cylindrical inner surface concentric with and having a smaller diameter than the outer surface;

a central aperture defined by the exterior of the inner surface, the central aperture sized to allow passage of a chill pipe;

a plurality of inner cavities disposed within the sealing element between the inner surface and the outer surface, each of the inner cavities having an opening through the outer surface;

wherein upon introduction of a pressurized fluid into the inner cavities through each of the openings, the diameter of the outer surface remains fixed and the diameter of the inner surface decreases; wherein the inner cavities control the deformation of the inner surface as the diameter of the inner surface decreases; and wherein the inner cavities cause the inner wall of the sealing element to constrict the innermost cylindrical member in a twisting action.

9. The sealing element of claim 8 wherein the cavities are triangular when viewed in cross-section.

10. The sealing element of claim 8 wherein the inner wall of the sealing element does not wrinkle when the sealing element constricts the innermost cylindrical member.

11. The sealing element of claim 8 wherein the innermost cylindrical member is a drill pipe.

12. The sealing element of claim 8 wherein the sealing element is incorporated into a rotating pressure control head.

13. The sealing element of claim 8 wherein the sealing element is incorporated into a blowout preventer stack.

14. The sealing element of claim 8 wherein the sealing element is incorporated into a rotating pressure control head adapted for engagement to a separation vessel.

15. A rotating pressure control head comprising:

an upper body; and a lower body;

wherein the upper body comprises:

an outer housing;

an inner housing that rotates with respect to the outer housing;

a sealing element fixed within the inner housing;

wherein the sealing element comprises:

a plurality of internal cavities;

a plurality of apertures connecting the internal cavities to a pressurized fluid;

wherein inflation of the cavities by the pressurized fluid causes an inner wall of the sealing element to constrict a drill pipe in a predictable manner;

wherein the upper body secures to the lower body in a locked position by aligning at least four sets of upper discontinuous threads with a plurality of spaces between at least four sets of lower discontinuous threads;

wherein the upper body rotates less than forty-five degrees with respect to the lower body between the locked position and an unlocked position;

wherein the upper body and lower body are adapted to be moved manually to the locked position and to the unlocked position;

wherein the upper body is removable from the lower body without any further rotation when the upper body is in the unlocked position; and wherein the upper body must be rotated at least twenty degrees with respect to the lower body between the locked position and the unlocked position.

16. The rotating pressure control head of claim 15 wherein the sealing element further comprises a plurality of internal cavities are triangular when viewed in cross-section.

17. The rotating pressure control head of claim 16 wherein the sealing element further comprises a plurality of internal cavities causes the inner wall of the sealing element to constrict the drill pipe in a twisting action.

18. The rotating pressure control head of claim 17 wherein the sealing element further comprises an inner wall of the sealing element does not wrinkle when the sealing element constricts the drill pipe.

19. The rotating pressure control head of claim 18 wherein the rotating pressure control head is incorporated in a blowout preventer stack.

20. The rotating pressure control head of claim 18 wherein the rotating pressure control head is adapted for connection to a separation vessel.

21. An apparatus comprising:

an upper body removably connected to a lower body by discontinuous threads;

wherein the upper body comprises:

an outer housing;

a sealing element adapted for rotation within the outer housing;

an inner housing rotatably engaged within the outer housing and adapted for holding the sealing element;

wherein the inner housing is rotatably engaged with the outer hosing by a first bearing configured to support the vertical load placed upon the upper body and by a second bearing configured to support the horizontal load placed upon the upper body;

wherein the sealing element comprises a plurality of internal cavities;

a plurality of apertures for connecting the internal cavities to a pressurized fluid;

wherein inflation of the cavities by the pressurized fluid causes an inner wall of the sealing element to constrict the drill pipe in a predictable manner;

wherein the upper body secures to the lower body in a locked position by twisting and interlocking at least four sets of upper discontinuous threads at least four sets of lower discontinuous threads;

wherein the upper body rotates in range less than forty-five degrees with respect to the lower body between the locked position and an unlocked position; and wherein the upper body and lower body are adapted to be moved manually to the locked position and to the unlocked position.

22. The apparatus of claim 21 wherein the sealing element further comprises cavities that are triangular when viewed in cross-section.

23. The apparatus of claim 22 wherein the sealing element further comprises cavities that cause the inner wall of the sealing element to constrict the drill pipe in a twisting action.

24. The apparatus of claim 23 wherein the inner wall of the sealing element does not wrinkle when the sealing element constricts the drill pipe.

25. The apparatus of claim 24 wherein the apparatus is included in a blowout preventer stack.

26. The apparatus of claim 24 wherein the apparatus is adapted for engagement to a separation vessel.

27. The apparatus of claim 21 wherein the lower body has an outlet adapted for connection to a separation vessel.

28. The apparatus of claim 21 wherein a division of a workload between the first bearing and the second bearing decreases a plurality of harmonic vibrations caused by a rotation of the drill pipe.

29. The apparatus of claim 21 wherein a plurality of positions of the first bearing and the second bearing decreases a plurality of harmonic vibrations caused by a rotation of the drill pipe.

30. The sealing element of claim 23 wherein the constriction of the sealing element about the drill pipe is sufficient for a drilling operation.

31. The apparatus of claim 21 wherein the pressurized fluid is a drilling fluid.

32. The apparatus of claim 21 wherein the pressurized fluid is a hydraulic fluid.

33. The apparatus of claim 21 wherein the inner wall of the sealing element is caused to move away from the drill pipe by reducing the pressure in the cavities by means of a vacuum pump attached to a port in the outer housing.

34. The apparatus of claim 21 wherein the pressurized fluid enters the plurality of internal cavities through a port in the outer housing, a first channel, a plurality of apertures in an inner housing, and a second channel in the inner housing.

35. The apparatus of claim 21 wherein the pressurized fluid enters the plurality of internal cavities directly through a plurality of apertures in the sealing element.

36. A rotating pressure control head comprising:

an upper body having an outer housing, a plurality of upper rapid engagement threads affixed to the outer housing, an inner housing rotatably engaged within the outer housing;

a lower body having an plurality of lower rapid engagement threads;

a sealing element removeably engaged to the inner housing and having a plurality of internal cavities and having a plurality of apertures for connecting the internal cavities to a pressurized fluid;

wherein inflation of the plurality of internal cavities by the pressurized fluid causes an inner wall of the sealing element to constrict a drill pipe in the rotating pressure control head in a twisting action;

wherein the upper body engages the lower body by a twisting and interlocking of the upper rapid engagement threads with the lower rapid engagement threads; and wherein the inner housing is rotatably engaged with the outer hosing by a first bearing configured to support the vertical load placed upon the upper body and by a second bearing configured to support the horizontal load placed upon the upper body.

37. The rotating pressure control head of claim 36 wherein the pressurized fluid enters the plurality of internal cavities through a port in the outer housing, a first channel in the outer housing, a plurality of apertures in an inner housing, and a second channel in the inner housing.

38. The rotating pressure control head of claim 36 wherein the pressurized fluid is a drilling fluid that enters directly into the plurality of internal cavities.

* * * * *